United States Patent [19]

Allen

[11] 4,171,669

[45] Oct. 23, 1979

[54] DECOY FLARE

[75] Inventor: Edward A. Allen, Ridgecrest, Calif.

[73] Assignee: The United States of America as represented by the Secretary of the Navy, Washington, D.C.

[21] Appl. No.: 877,070

[22] Filed: Feb. 13, 1978

[51] Int. Cl.[2] ..... F42B 4/02; F42B 4/26

[52] U.S. Cl. ..... 102/37.6; 102/37.8; 102/87; 102/90

[58] Field of Search ..... 102/34.4, 35.6, 37.6, 102/37.8, 6, 65, 66, 90, 60, 87; 89/1.5 R

[56] References Cited

U.S. PATENT DOCUMENTS

| | | | |
|---|---|---|---|
| 3,150,848 | 9/1964 | Lager | 244/3.16 |
| 3,243,270 | 3/1966 | Flanagan | 102/65 |
| 3,439,612 | 4/1969 | Lai | 102/37.8 |
| 3,473,472 | 10/1969 | Bliss et al. | 102/87 X |
| 3,612,857 | 10/1971 | Beatty et al. | 102/37.6 |
| 3,712,224 | 1/1973 | Hanzel | 102/37.6 |
| 3,736,874 | 6/1973 | Gerber | 102/37.6 |
| 3,808,940 | 5/1974 | Schillreff | 89/1 R |
| 3,841,219 | 10/1974 | Schillreff | 102/37.6 |
| 3,964,393 | 6/1976 | Foote et wal. | 102/37.6 |

FOREIGN PATENT DOCUMENTS

| | | | |
|---|---|---|---|
| 2509539 | 12/1976 | Fed. Rep. of Germany | 102/90 |

*Primary Examiner*—Verlin R. Pendegrass

*Attorney, Agent, or Firm*—R. S. Sciascia; W. Thom Skeer; J. H. Lynn

[57] ABSTRACT

A decoy flare cartridge for use in an aircraft photoflash cartridge rack. Hydrocarbon compound plus gelling agents are placed in a photoflash cartridge. A primer in the base of the cartridge is fired to propel a piston which forces the gel out of the cartridge through an orifice plate. The expelled hydrocarbon compounds are then ignited to form an infrared source for decoying a hostile infrared seeking missile away from the tailpipe of the decoy-carrying aircraft.

5 Claims, 2 Drawing Figures

DECOY FLARE

BACKGROUND OF THE INVENTION

1. Field of the Invention

The present invention pertains to a device for providing an infrared source which will decoy an infrared-seeking missile and, more particularly, to such devices which incorporate gelled hydrocarbons as fuel.

2. Description of the Prior Art

Anti-aircraft missiles having guidance systems commonly are designed to home on infrared energy generated by a turbojet engine tailpipe or exhaust plume. Such missiles are sensitive to infrared energy in precise preselected wavelengths which are generated by the hot tailpipe or exhaust plume. Such missiles are commonly countermeasured by launching a high temperature source from the aircraft which will generate infrared energy in that portion of the spectrum to which the missile is sensitive. The missile then breaks lock from the aircraft and locks in on the decoy infrared source and permits the aircraft to escape.

Such infrared sources have comprised bore safe flares, which ignite and burn at a very high temperature, and apparatus aboard the aircarft which mixes a liquid fuel with an oxidizer in a predetermined ratio and expels and ignited periodic quanta of the mixture to create a plurality of burning fuel clouds each of which produces infrared energy in the approximate wavelengths as does the aircraft tailpipe or exhaust plume.

Previous decoy flare systems have required modification to aircraft structure for attachment, and may require the handling of bulk fuel to recharge them. Once loaded, elaborate system purging procedures may be required to change the character of fuel within the system storage tank. Flares which utilize solid fuel will often burn at a higher temperature and, therefore, produce a different spectral signature than that produced by the tailpipe or exhaust plume of a turbojet engine.

SUMMARY OF THE INVENTION

The present invention introduces great convenience to the prior art and overcomes the problems therein by providing a standard photoflash cartridge for use in a standard photoflash ejector rack on an aircraft with a charge of gelled hydrocarbon material which may be ejected by simply firing the photoflash cartridge.

A standard photoflash cartridge is equiped with a primer, ignition and expulsion pellets, a sealed piston, an orifice plate, and an end closure. A charge of gelled hydrocarbon material is placed between the piston and the orifice plate. The assembled photoflash cartridge, which has been modified to produce a decoy flare, is then inserted in the usual manner in an aircraft photo flash ejector rack. When the aircraft pilot wishes to dispense an infrared decoy, the pilot merely fires the cartridge in the usual manner. The primer at one end of the cartridge fires and ignites a charge of ignition pellets. Gas pressure from the primer and ignition pellets forces a piston the length of the interior of the cartridge and simultaneously forces the gelled hydrocarbon material through an orifice plate and out the end of the case. An enclosure cap which is provided to seal the case during storage is forced away, and the gelled hydrocarbons, after passing through the orifice plate, form a cloud which is then ignited by the ignition pellets which are also expelled from the cartridge. The burning cloud thus formed emits infrared radiation in approximately the same wavelengths as does the tailpipe or exhaust plume of the turbojet engine. An infrared seeking missile, seeing the burning cloud, locks in on the stronger source of infrared energy and permits the aircraft to escape.

BRIEF DESCRIPTION OF THE DRAWING

Further advantages of the present invention will emerge from a description which follows of the preferred embodiment of a decoy flare cartridge according to the invention, given with reference to the accompanying drawing figures, in which.

DESCRIPTION OF THE PREFERRED EMBODIMENT

Figure 1:
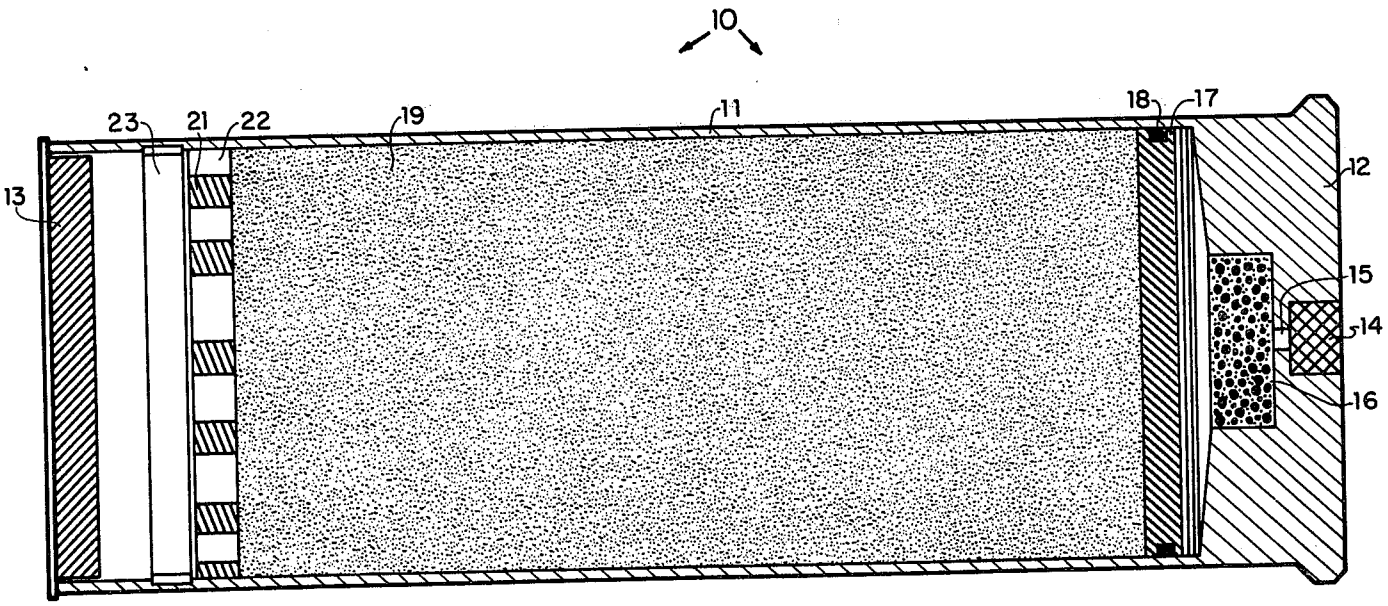
FIG. 1 illustrates in section a decoy flare cartridge according to the invention.

Referring now to the drawings, wherein like reference numerals correspond to like parts and elements throughout the several views, there is shown in FIG. 1 decoy flare cartridge 10 having shell 11 and head 12. Primer 14 is shown retained in head 12. A flash hole 15 communicates between primer 14 and ignition pellets 16.

Piston 17 having O-ring seal 18 is shown in FIG. 1 within shell 11 and near ignition pellets 16. Gelled hydrocarbon fuel 19 occupies the central volume of shell 11. Orifice plate 21 having openings 22 is placed within shell 11 at the end opposite head 12. Groove 24 accomodates retaining ring 23 and prevents expulsion of orifice plate 21 upon flare cartridge activation. End closure cap 13 completes the assembly and seals the contents of shell 11 against environmental damage prior to use.

Figure 2:
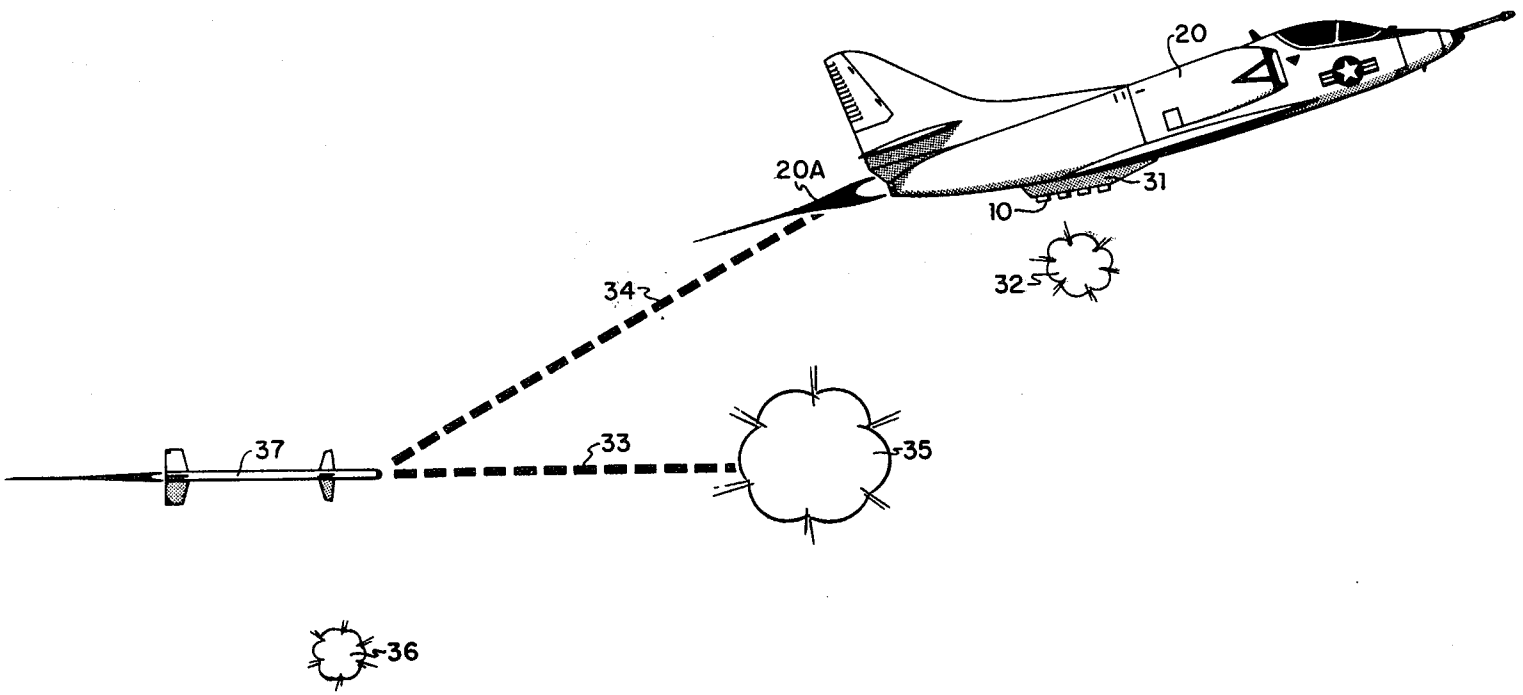
FIG. 2 illustrates an aircraft utilizing the present invention.

Referring now to FIG. 2, there is shown aircraft 20 equipped with a plurality of decoy flare cartridges 10 mounted within photoflash ejector rack 31. One of the cartridges 10 having just fired, a fuel cloud 32 has been formed. Fuel cloud 35, from an earlier firing has been ignited and is emitting infrared energy at approximately the same spectral region as is tailpipe 2*a*. Previously formed cloud 36 has expended its fuel and is burning out. Missile 37, previously locked on to aircraft tailpipe 20*a* or the exhaust plume, has been decoyed to lock on to fuel cloud 35. Missile 37 then follows trajectory 33 rather than trajectory 34.

Photoflash ejector rack 31 is mounted in the conventional manner either under the wing in a pod, or to or within the fuselage, depending upon the particular aircraft involved. Decoy flare cartridge 10 is loaded into the standard photoflash ejector rack 31 mounted on an aircraft. More than one cartridge 10 may be loaded into ejector rack 31 depending upon the capacity thereof. Upon a firing actuation, an electrical impulse fires primer 14, causing it to ignite ignition pellets 16 through flash hole 15. Gas pressure resulting from ignition of primer 14 and pellets 16 builds up behind piston 17 and causes piston 17 to move toward orifice plate 21. Plate 21, being retained in position by retaining ring 23, remains fixed. Gelled hydrocarbon fuel 19 is forced through openings 22 in plate 21 and forces end cap 13 away from shell 11. The velocity of expulsion of hydrocarbon fuel 19 causes the fuel to atomize upon passing through orifice plate 21, and the fuel forms an combustible cloud. Piston 17, upon striking orifice plate 21, carries plate 21 from shell 11, and permits ignition pellets 16 to ignite cloud 32. The cartridge of this invention may be reloaded with additional components for reuse, or the cartridge may be expended after a single use depending upon the materials used in its construction.

The size of fuel cloud 32 produced by the present invention may be tailored by variations in the orifice plate, or the orifice plate may be omitted altogether. Also, the igniter pellets may be omitted if some other means is provided for igniting the formed fuel cloud. Black powder, or boron-potassium nitrate may be used as an expelling charge in place of pellets 16. Primer 14 may be a mechanically initiated primer if desired. Shell 11 is sealed by end closure cap 13; and the sealed unit 10 may be easily handled aboard ship, stored in magazines, and loaded and down loaded as a sealed unit.

Other variations in design of the flare cartridge may utilize an expelling primer located in the base for powering expulsion piston 17 and one or more igniting primers mounted in the muzzle end of cartridge shell 11. The igniting primers would serve to ignite the gel as it exits shell 11. Also, shell 11 could contain a central core tube, which may be perforated, and which contains ignition pellets. These pellets would be ejected by the expulsion piston to ignite the gel without the need for muzzle mounted igniting primers.

Pellets 16 may be made from any commonly used pyrotechnic type material, such as black powder or boron-potassium nitrate, which is readily available. Similarly, a fuel, such as gelled gasoline, gelled kerosene, or other gelled fuel, may be used for fuel 19.

Obviously many modifications and variations of the present invention are possible in the light of the above teachings. It is therefore to be understood that within the scope of the appended claims, the invention may be practiced otherwise than as specifically described.

What is claimed is:

1. A decoy flare cartridge, comprising:

a hollow case having an open end and a closed end, and having a primer and an expulsion charge retained at said closed end in cooperate proximity;

a piston slidably position within said hollow case for motion between first and second postions, said piston sealingly engaging the inner walls of said case;

an orifice plate retained within said hollow case at said open end;

a cap attached to said case and closing said open end;

an internal groove in said case near said open end between said orifice plate and said cap;

a retaining ring occupying said groove for retaining said orifice plate within said case; and a charge of jelled hydrocarbon fuel contained within said case between said piston and said orifice plate.

2. A decoy flare cartridge as set forth in claim 1 in combination with firing apparatus.

3. A decoy flare cartridge and firing apparatus as set forth in claim 2 wherein said firing apparatus comprises a photoflash rack.

4. A decoy flare cartridge as set forth in claim 1 wherein said expulsion charge comprises black powder.

5. A decoy flare cartridge as set forth in claim 1 wherein said expulsion charge comprises boron-potassium nitrate.

* * * * *